US005963458A

United States Patent [19]

Cascia

[11] Patent Number: 5,963,458

[45] Date of Patent: Oct. 5, 1999

[54] DIGITAL CONTROLLER FOR A COOLING AND HEATING PLANT HAVING NEAR-OPTIMAL GLOBAL SET POINT CONTROL STRATEGY

[75] Inventor: Mark A. Cascia, Barrington, Ill.

[73] Assignee: Siemens Building Technologies, Inc., Buffalo Grove, Ill.

[21] Appl. No.: 08/902,088

[22] Filed: Jul. 29, 1997

[51] Int. Cl.[6] ..... G05B 11/50; G05B 6/02; F28B 9/04

[52] U.S. Cl. ..... 364/528.35; 364/528.34; 364/528.11; 62/129; 62/201; 165/200; 165/287; 236/84

[58] Field of Search ..... 364/528.35, 528.34, 364/528.11; 62/201, 129, DIG. 11; 165/200, 287; 236/84

[56] References Cited

U.S. PATENT DOCUMENTS

| | | | |
|---|---|---|---|
| 4,325,223 | 4/1982 | Cantley | 62/126 |
| 4,393,662 | 7/1983 | Dirth | 62/115 |
| 4,418,381 | 11/1983 | Molusis et al. . | |
| 4,873,649 | 10/1989 | Grald et al. | 364/505 |
| 4,884,214 | 11/1989 | Parker et al. . | |
| 4,916,909 | 4/1990 | Mathur et al. . | |
| 4,931,948 | 6/1990 | Parker et al. . | |
| 5,040,377 | 8/1991 | Braun et al. | 62/183 |
| 5,114,070 | 5/1992 | Lilja et al. . | |
| 5,181,653 | 1/1993 | Foster et al. . | |
| 5,544,036 | 8/1996 | Brown, Jr. et al. . | |
| 5,544,809 | 8/1996 | Keating et al. . | |
| 5,555,195 | 9/1996 | Jensen et al. . | |
| 5,573,181 | 11/1996 | Ahmed . | |
| 5,579,993 | 12/1996 | Ahmed et al. . | |
| 5,600,960 | 2/1997 | Schwedler et al. | 62/99 |

FOREIGN PATENT DOCUMENTS

| | | |
|---|---|---|
| 0085454 | 8/1983 | European Pat. Off. . |
| 9806987 | 2/1998 | WIPO . |

OTHER PUBLICATIONS

J.E. Braun, S.A. Klein, W.A. Beckman, J.W. Mitchell, "Methodologies for Optimal Control of Chilled Water Systems Without Storage", Ashrae Transactions, vol. 95, No. P1, 1989, pp. 652–662, XP–002083857.

J.E. Braun, S.A. Klein, J.W. Mitchell, W.A. Beckman, "Applications of Optimal Control to Chilled Water Systems without Storage", Ashrae Transactions, vol. 95, No. P1, 1989, pp. 663–675, XP–002083858.

J.E. Braun, J.W. Mitchell, S.A. Klein, "Performance and Control Characteristics of a Large Cooling System", Ashrae Transactions, vol. 93, No. P1, 1987, pp. 1830–1852, XP–002083859.

L.L. Enterline, A.C. Sommer, A. Kaya, "Chiller Optimization by Distributed Control", Proceedings of the Instrument Society of America Conference, 1983, pp. 1137–1149, XP–002083860.

*Primary Examiner*—William Grant
*Assistant Examiner*—Peter W. Eissmann
*Attorney, Agent, or Firm*—Greer, Burns & Crain, Ltd.

[57] ABSTRACT

A DDC controller is disclosed which implements a control strategy that provides for near-optimal global set points, so that power consumption and therefore energy costs for operating a heating and/or cooling plant can be minimized. Tile controller can implement two chiller plant component models expressing chiller, chilled water pump, and air handler fan power as a function of chilled water supply/return differential temperature. The models are derived from a mathematical analysis using relations from fluid mechanics and heat transfer under the assumption of a steady-state load condition. The analysis applies to both constant speed and variable speed chillers, chilled water pumps, and air handler fans. Similar models are presented for a heating plant consisting of a hot water boiler, hot water pump, and air handler fan which relates power as a function of the hot water supply/return differential temperature. A relatively simple technique is presented to calculate near-optimal chilled water and hot water set point temperatures whenever a new steady-state load occurs, in order to minimize total power consumption. From the calculated values of near-optimal chilled water and hot water supply temperatures, a near-optimal discharge air temperature from a central air handler can be calculated for each step in load. Although the set points are near-optimal, the technique of calculation is simple enough to implement in a DDC controller.

8 Claims, 2 Drawing Sheets

DIGITAL CONTROLLER FOR A COOLING AND HEATING PLANT HAVING NEAR-OPTIMAL GLOBAL SET POINT CONTROL STRATEGY

The present invention is generally related to a digital controller for use in controlling a cooling and heating plant of a facility, and more particularly related to such a controller which has a near-optimal global set point control strategy for minimizing energy costs during operation.

BACKGROUND OF THE INVENTION

Cooling plants for large buildings and other facilities provide air conditioning of the interior space and include chillers, chilled water pumps, condensers, condenser water pumps, cooling towers with cooling tower fans, and air handling fans for distributing the cool air to the interior space. The drives for the pumps and fans may be variable or constant speed drives. Heating plants for such facilities include hot water boilers, hot water pumps, and air handling fans. The drives for these pumps and fans may also be variable or constant speed drives.

Global set point optimization is defined as the selection of the proper set points for chilled water supply, hot water supply, condenser water flow rate, tower fan air flow rate, and air handler discharge temperature that result in minimal total energy consumption of the chillers, boilers, chilled water pumps, condenser water pumps, hot water pumps, and air handling fans. Determining these optimal set points holds the key to substantial energy savings in a facility since the chillers, towers, boilers, pumps, and air handler fans together can comprise anywhere from 40% to 70% of the total energy consumption in a facility.

There has been study of the matter of determining optimal set points in the past. For example, in the article by Braun et al. 1989b. "Methodologies for optimal control of chilled water systems without storage", *ASHRAE Transactions*, Vol. 95, Part 1, pp. 652–62, they have shown that there is a strong coupling between optimal values of the chilled water and supply air temperatures; however, the coupling between optimal values of the chilled water loop and condenser water loop is not as strong. (This justifies the approach taken in the present invention of considering the chilled water loop and condenser water/cooling tower loops as separate loops and treating only the chiller, the chilled water pump, and air handler fan components to determine optimal ΔT of the chilled water and air temperature across the cooling coil.)

It has also been shown that the optimization of the cooling tower loop can be handled by use of an open-loop control algorithm (Braun and Diderrich, 1990, "Performance and control characteristics of a large cooling system." *ASHRAE Transactions*, Vol. 93, Part 1, pp. 1830–52). They have also shown that a chance in wet bulb temperature has an insignificant influence on chiller plant power consumption and that near-optimal control of cooling towers for chilled water systems can be obtained from an algorithm based upon a combination of heuristic rules for tower sequencing and an open-loop control equation. This equation is a linear equation in only one variable, i.e., load, and correlates a near-optimal tower air flow in terms of load (part-load ratio).

$$G_{twr}=1-\beta_{twr}(PLR_{twr,cap}-PLR)\quad 0.25<PLR<1.0 \tag{1}$$

where $G_{twr}$=the tower air flow divided by the maximum air flow with all cells operating at high speed PLR=the chilled water load divided by the total chiller cooling capacity (part-load ratio)

$PLR_{twr,cap}$=value of PLR at which the tower operates at its capacity ($G_{twr}$=)

$\beta_{twr}$=the slope of the relative tower air flow ($G_{twr}$) versus the PLR function.

Estimates of these parameters may be obtained using design data and relationships presented in Table 1 below:

TABLE 1

Parameter Estimates for Eqn. 1

| Parameter | Single-Speed Fans | Two-Speed Fans | Variable-Speed Fans |
|---|---|---|---|
| $PLR_{twr,cap}$ | $PLR_0$ | $\sqrt{2}\cdot PLR_0$ | $\sqrt{3}\cdot PLR_0$ |
| $\beta_{twr}$ | $\frac{1}{PLR_{twr,cap}}$ | $\frac{2}{3\cdot PLR_{twr,cap}}$ | $\frac{1}{2\cdot PLR_{twr,cap}}$ |

$$PLR_0=\frac{(1)}{\left(\sqrt{\left(\frac{P_{ch,des}}{P_{twr,des}}\right)\cdot S\cdot(a_{twr,des}+r_{twr,des})}\right)}$$

where:

$\left(\frac{P_{ch,des}}{P_{twr,des}}\right)$ = the ratio of the chiller power to cooling tower fan power at design conditions TABLE 1-continued Parameter Estimates for Eqn. 1

| Parameter | Single-Speed Fans | Two-Speed Fans | Variable-Speed Fans |
|---|---|---|---|

$$S = \text{Sensitivity} = \frac{(\text{change in chiller power})}{(\text{change in condenser water temperature}) \times (\text{chiller power})}$$

$(a_{twr,des} + r_{twr,des})$ = the sum of the tower approach and range at design conditions Once a near-optimal tower air flow is determined, Braun et al., 1987, "Performance and control characteristics of a large cooling system." *ASHRAE Transactions*, Vol. 93, Part 1, pp. 1830–52 have shown that for a tower with an effectiveness near unity, the optimal condenser flow is determined when the thermal capacities of the air and water are equal.

Cooling tower effectiveness is defined as:

$$\varepsilon = \frac{Q_{tower}}{\text{Min}(Q_{a,\max}, Q_{w,\max})}$$

where $\epsilon$=effectiveness of cooling tower $Q_{a,max}=m_{a,twr}(h_{s,cwr}-h_{s,i})$, sigma energy,$h_{s,_}=h_{air,_}-\omega_{_}c_{pw}T_{wb}$ $$Q_{w,max}=m_{cw}c_{pw}(T_{cwr}-T_{wb}) \quad (2)$$

$m_{a,twr}$=tower air flow rate $m_{cw}$=condenser water flow rate $T_{cwr}$=condenser water return temperature $T_{wb}$=ambient air wet bulb temperature A DDC controller can calculate the effectiveness, $\epsilon$, of the cooling tower, and if it is between 0.9 and 1.0 (Braun et al. 1987), $m_{cw}$ can be calculated from equating $Q_{a,max}$ and $Q_{w,max}$ once $m_{a,twr}$ is determined from Eqn. 1. Near-optimal operation of the condenser water flow and the cooling tower air flow can be obtained when variable speed drives are used for both the condenser water pumps and cooling tower fans.

Braun et al. (1989a. "Applications of optimal control to chilled water systems without storage." *ASHRAE Transactions*, Vol. 95, Part 1, pp. 663–75; 1989b. "Methodologies for optimal control of chilled water systems without storage", *ASHRAE Transactions*, Vol. 95, Part 1, pp. 652–62; 1987, "Performance and control characteristics of a large cooling system." *ASHRAE Transactions*, Vol. 93, Part 1, pp. 1830–52.) have done a number of pioneering studies on optimal and near-optimal control of chilled water systems. These studies involve application of two basic methodologies for determining optimal values of the independent control variables that minimize the instantaneous cost of chiller plant operation. These independent control variables are: 1) supply air set point temperature, 2) chilled water set point temperature, 3) relative tower air flow (ratio of the actual tower air flow to the design air flow), 4) relative condenser water flow (ratio of the actual condenser water flow to the design condenser water flow), and 5) the number of operating chillers.

One methodology uses component-based models of the power consumption of the chiller, cooling tower, condenser and chilled water pumps, and air handler fans. However, applying this method in its full generality is mathematically complex because it requires simultaneous solution of differential equations. In addition, this method requires measurements of power and input variables, such as load and ambient dry bulb and wet bulb temperatures, at each step in time. The capability of solving simultaneous differential equations is lacking in today's DDC controllers. Therefore, implementing this methodology in an energy management system is not practical.

Braun et al. (1987, 1989a, 1989b) also present an alternative, and somewhat simpler methodology for near-optimal control that involves correlating the overall system power consumption with a single function. This method allows a rapid determination of optimal control variables and requires measurements of only total power over a range of conditions. However, this methodology still requires the simultaneous solution of differential equations and therefore cannot practically be implemented in a DDC controller.

Optimal air-side and water-side control set points were identified by Hackner et al. (1985, "System Dynamics and Energy Use." ASHRAE Journal, June.) for a specific plant through the use of performance maps. These maps were generated by many simulations of the plant over the range of expected operating conditions. However, this procedure lacks generality and is not easily implemented in a DDC controller.

Braun et al. (1987) has suggested the use of a bi-quadratic equation to model chiller performance of the form:

$$\frac{P_{ch}}{P_{des}} = a + bx + cx^2 + dy + ey^2 + fxy \quad (3)$$

where "x" is the ratio of the load to a design load, "y" is the leaving condenser water temperature minus the leaving chilled water temperature, divided by a design value, $P_{ch}$ is the actual chiller power consumption, and $P_{des}$ is the chiller power associated with the design conditions. The empirical coefficients of the above equation (a, b, c, d, e, f) are determined with linear least-squares curve-fitting applied to measured or modeled performance data. This model can be applied to both variable speed and constant speed chillers.

Kaya et al. (1983, "Chiller optimization by distributed control to save energy", Proceedings of the instrument Society of America Conference, Houston, Tex.) has used a component-based approach for modeling the power consumption of the chiller and chilled water pump under steady-state load conditions. In his paper, the chiller component power is approximated to be a linear function of the chilled water differential temperature, and chilled water pump component power to be proportional to the cube of the reciprocal of the chilled water differential temperature for each steady-state load condition.

$$P_{Tot}(\Delta T_{chw}) = P_{comp}(\Delta T_{chw}) + P_{pump}(\Delta T_{chw}) \quad (4)$$

$$= K_{comp} \cdot \Delta T_{chw} + K_{pump} \cdot \left(\frac{1}{\Delta T_{chw}}\right)^3$$

where $P_{Tot}$=the total power consumption $P_{comp}$=the power consumption of the chiller's compressor $P_{pump}$=the power consumption of the chilled water pump $\Delta T_{chw}$=the supply/return chilled water temperature $K_{comp}$, $K_{pump}$=constants, dependent on load While the above described work allows the calculation of the optimal $\Delta T_{chw}$, it lacks generality since the power consumption of the air handler fans is not considered in the analysis.

Accordingly, it is a primary object of the present invention to provide an improved digital controller for a cooling and heating plant that easily and effectively implements a near-optimal global set point control strategy.

A related object is to provide such an improved controller which enables a heating and/or cooling plant to be efficiently operated and thereby minimizes the energy costs involved in such operation.

Yet another object of the present invention is to provide such a controller that is adapted to provide approximate instantaneous cost savings information for a cooling or heating plant compared to a baseline operation.

A related object is to provide such a controller which provides accumulated cost savings information.

These and other objects of the present invention will become apparent upon reading the following detailed description while referring to the attached drawings.

DETAILED DESCRIPTION

Broadly stated, the present invention is directed to a DDC controller for controlling such heating and cooling plants that is adapted to quickly and easily determine set points that are near-optimal, rather than optimal, because neither the condenser water pump power nor the cooling tower fan power are integrated into the determination of the set points.

The controller uses a strategy that can be easily implemented in a DDC controller to calculate near-optimal chilled water, hot water, and central air handler discharge air set points in order to minimize cooling and heating plant energy consumption. The component models for the chiller, hot water boiler, chilled water and hot water pumps and air handler fans power consumption have been derived from well known heat transfer and fluid mechanics relations.

The present invention also uses a strategy that is similar to that used by Kaya et al. for determining the power consumed by the air handler fans as well as the chiller and chilled water pumps. First, the simplified linear chiller component model of Kaya et al. is used for the chilled water pump and air handler component models, then a more general bi-quadratic chiller model of Braun (1987) is used for the chilled water pump and air handler component models. In both of these cooling plant models, the total power consumption in the plant can be represented as a function of only one variable, which is the chilled water supply/return differential temperature $\Delta T_{chw}$. This greatly simplifies the mathematics and enables quick computation of optimal chilled water and supply air set points by the DDC controller embodying the present invention. In addition, a similar set of models and computations are used for the components of a typical heating plant—namely, hot water boilers, hot water pumps, and central air handler fans.

Figure 1:
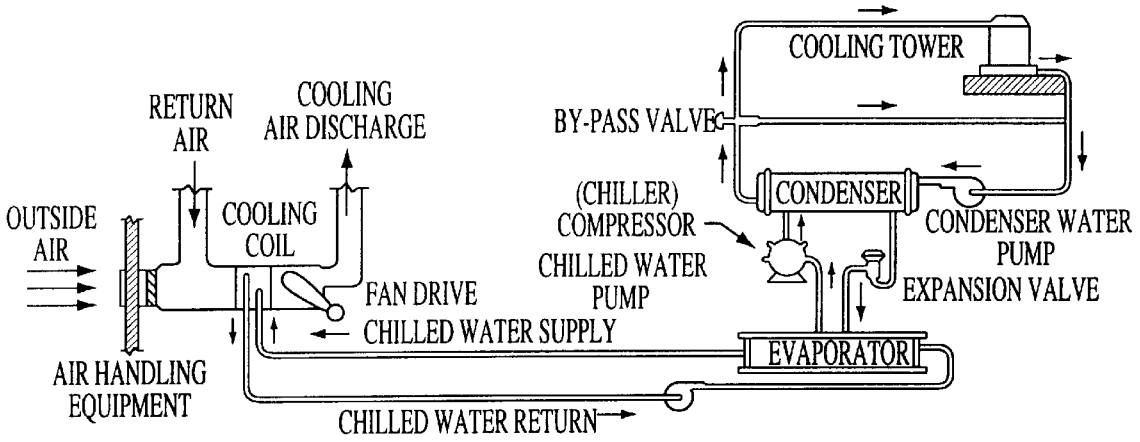
FIG. 1 is a schematic diagram of a generic cooling plant consisting of equipment that includes a chiller, a chilled water pump, a condenser water pump, a cooling tower, a cooling tower fan and an air handling fan.

Turning to the drawings and particularly FIG. 1, a generic cooling plant is illustrated and is the type of plant that the digital controller of the present invention can operate. The drawing shows a single chiller, but could and often does have multiple chillers. The plant operates by pumping chilled water returning from the building, which would be a cooling coil in the air handler duct, and pumping it through the evaporator of the chiller. The evaporator cools the chilled water down to approximately 40 to 45 degrees F and it then is pumped back up through the cooling coil to further cool the air. The outside air and the return air are mixed in the mixed air duct and that air is then cooled by the cooling coil and discharged by the fan into the building space.

In the condenser water loop, the cooling tower serves to cool the hot water leaving the condenser to a cooler temperature so that it can condense the refrigerant gas that is pumped by the compresser from the evaporator to the condenser in the refrigerant loop. With respect to the refrigeration loop comprising the compressor, evaporator and the condenser, the compressor compresses the refrigerant gas into a high temperature, high pressure state in the condenser, which is nothing more than a shell and tube heat exchanger. On the shell side of the condenser, there is hot refrigerant gas, and on the tube side, there is cool cooling tower water. In operation, when the cool tubes in the condenser are touched by the hot refrigerant gas, it condenses into a liquid which gathers at the bottom of the condenser and is forced through an expansion valve which causes its temperature and pressure to drop and be vaporized into a cold gaseous state. So the tubes are surrounded by cold refrigerant gas in the evaporator, which is also a shell and tube heat exchanger, with cold refrigerant gas on the shell side and returned chilled water on the tube side. So the chilled water coming back from the building is cooled. The approximate temperature drop between supply and returned chilled water is about 10 to 12 degrees F. at full load conditions.

The present invention is directed to a controller that controls the cooling a plant to optimize the supply chilled water going to the coil and the discharge air temperature off the coil, considering the chilled water pump energy, the chiller energy and the fan energy. The controller is trying to determine the discharge air set point and the chilled water set point such that the load is satisfied at the minimum power consumption.

The controller utilizes a classical calculus technique, where the chiller power, chilled water pump power and air handler power are modeled as functions of the $\Delta T_{chw}$ and summed in a polynomial function (the total power), then the first derivative of the functional relationship of the total power is set to zero and the equation is solved for $\Delta T_{chw}$ which is the optimum $\Delta T_{chw}$.

Figure 2:
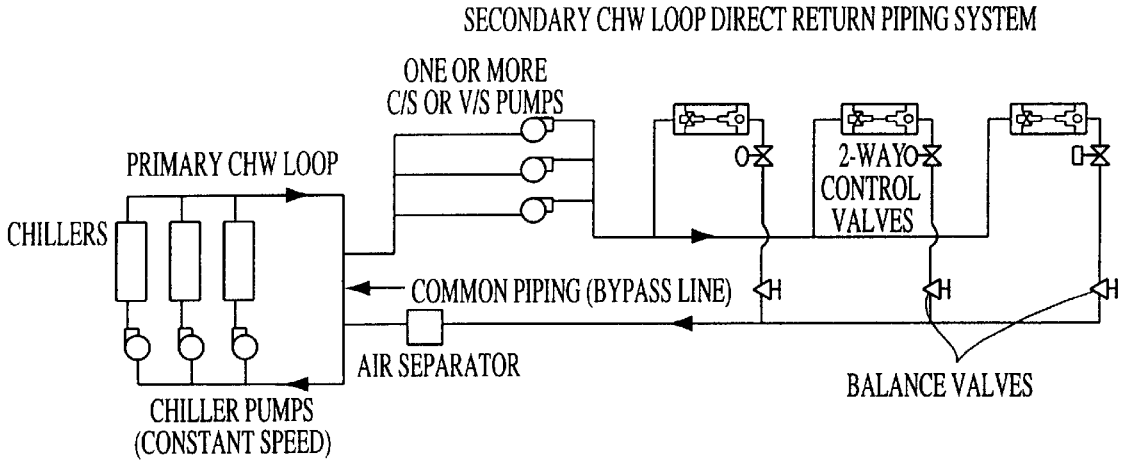
FIG. 2 is a schematic diagram of another generic cooling plant having primary-secondary chilled water loops, multiple chillers, multiple chilled water pumps and multiple air handling fans.

The schematic diagram of FIG. 2 is another typical chiller plant which includes multiple chillers, multiple chilled water pumps, multiple air handler fans and multiple air handler coils. The present invention is applicable to controlling plants of the type shown in FIGS. 1, 2 or 3.

In accordance with an important aspect of the present invention, the controller utilizes a strategy that applies to both cooling and heating plants, and is implemented in a manner which utilizes several valid assumptions. A first assumption is that load is at a steady-state condition at the time of optimal chilled water, hot water and coil discharge air temperature calculation. Under this assumption, from basic heat transfer equations:

$$BTU/H=500\times GPM\times\Delta T_{chw}\equiv constant$$

$$BTU/H=4.5\times CFM\times\Delta h_{air}\equiv constant \quad (4)$$

It is evident that if flow is varied, the $\Delta T_{chw}$ or the $\Delta h_{air}$ must vary proportionately in order to keep the load fixed. This assumption is justified because time constants for chilled water, hot water, and space air temperature change control loops are on the order of 20 minutes or less, and facilities can usually hold at approximate steady-state conditions for 15 or 20 minutes at a time.

A second assumption is that the $\Delta T_{chw}$ and the $\Delta h_{air}$ are assumed to be constant at the time of optimal chilled water, hot water, and coil discharge air temperature calculation due to the local loop controls (the first assumption combined with the sixth assumption). Therefore, this implies that the GPM of the chilled water through the cooling coil and the CFM of the air across the cooling coil must also be constant at the time of optimal set point calculations.

A third assumption is that the specific heats of the water and air remain essentially constant for any load condition. This assumption is justified because the specific heats of the chilled water, hot water, and the air at the heat exchanger are only a weak function of temperature and the temperature change of either the water or air through the heat exchanger is relatively small (on the order 5–15° F. for chilled water temperature change and 20–40° F. for hot water or air temperature change).

A fourth assumption is that convection heat transfer coefficients are constant throughout the heat exchanger. This assumption is more serious than the third assumption because of entrance effects, fluid viscosity, and thermal conductivity changes. However, because water and air flow rates are essentially constant at steady-state load conditions, and fluid viscosity of the air and thermal conductivity and viscosity of the air and water vary only slightly in the temperature range considered, this assumption is also valid.

A fifth assumption is that the chilled water systems for which the following results apply do not have significant thermal storage characteristics. That is, the strategy does not apply for buildings that are thermally massive or contain chilled water or ice storage tanks that would shift loads in time.

A sixth assumption is that in addition to the independent optimization control variables, there are also local loop controls associated with the chillers, air handlers, and chilled water pumps. The chiller is considered to be controlled such that the specified chilled water set point temperature is maintained. The air handler local loop control involves control of both the coil water flow and fan air flow in order to maintain a given supply air set point and fan static pressure set point. Modulation of a variable speed primary chilled water pump is implemented through a local loop control to maintain a constant differential temperature across the evaporator. All local loop controls are assumed ideal, such that their dynamics can be neglected.

In accordance with an important aspect of the present invention, and referring to FIG. 1, the controller strategy involves the modeling of the cooling plant, and involves simple component models of cooling plant power consumption as a function of a single variable. The individual component models for the chiller, the chilled water pump, and the air handler fan are then summed to get the total instantaneous power consumed in the chiller plant.

$$P_{Tot}=P_{comp}+P_{CHW\ pump}+P_{AHU\ fan} \quad (5)$$

For the analysis which follows, we assume that the chiller, chilled water pump, and the air handler fan are variable speed devices. However, this assumption is not overly restrictive, since it will be shown that the analysis also applies to constant speed chillers, constant speed chilled water pumps with two-way chilled water valves, and constant speed, constant volume air handler fans without air bypass.

There are two distinct chiller models that can be used, one being a linear model and the other a bi-quadratic model. With respect to the linear model, Kaya et al. (1983) have shown that a first approximation for the chiller component of the total power under a steady-state load condition is:

$$P_{comp}=K_1\cdot\Delta T_{ref}=K_2\cdot\Delta T_{chw} \quad (7)$$

The derivation of the first half of Eqn. 7 is shown in the attached Appendix A. The second half of Eqn. 7 holds because as the chilled water supply temperature is increased for a given chilled water return temperature, $\Delta T_{chw}$ is decreased in the same proportion as $\Delta T_{ref}$.

With respect to the bi-quadratic model, an improvement of the linear chiller model is given by Braun et al. (1987). However, Braun's chiller model can be further improved when the bi-quadratic model is expressed in its most general form:

$$\frac{P_{ch}}{P_{des}} = (A_0 + A_1 y + A_2 y^2) + (B_0 + B_1 y + B_2 y^2)x + (C_0 + C_1 y + C_2 y^2)x^2 \quad (8)$$

where the empirical coefficients of the above equation ($A_0$, $A_1$, $A_2$, $B_0$, $B_1$, $B_2$, $C_0$, $C_1$, $C_2$) are determined with linear least-squares curve-fitting applied to measured performance data.

With respect to the chilled water pump model, the relationship of the chilled water pump power as a function of $\Delta T_{chw}$ as:

$$P_{pump} = K_5\cdot\left(\frac{1}{\Delta T_{chw}}\right)^2 \quad (9)$$

where $K_5$ is a constant. The derivation of this relationship is shown in the attached Appendix B.

With respect to the air handler model, the relationship of the chilled water pump power as a function of $\Delta T_{air}$ has been derived in attached Appendix C as:

$$P_{fan} = K_{fan} \cdot \left(\frac{1}{\Delta T_{air}}\right)^3 \tag{10}$$

$$P_{fan} = K_{fan} \cdot \left(\frac{1}{(\Delta T^*_{air}}\right)^3 \tag{11}$$

temperature difference across the coil.

In accordance with an important aspect of the present invention, the optimal chilled water/supply air delta T calculation can be made using a linear chiller model. The above relationships enable the total power to be expressed solely in terms of a function with variables $\Delta T_{chw}$ and $\Delta T^*_{air}$, with $\Delta T_{air}$ as follows:

$$P_{Tot}(\Delta T_{chw}, \Delta T_{air}) = P_{comp}(\Delta T_{chw}) + P_{pump}(\Delta T_{chw}) + P_{fan}(\Delta T^*_{air}) \tag{12}$$

$$= K_{comp} \cdot \Delta T_{chw} + K_{pump} \cdot \left(\frac{1}{\Delta T_{chw}}\right)^3 + K_{fan} \cdot \left(\frac{1}{\Delta T^*_{air}}\right)^3$$

for a wet surface cooling coil or $$P_{Tot}(\Delta T_{chw}, \Delta T_{air}) = P_{comp}(\Delta T_{chw}) + P_{pump}(\Delta T_{chw}) + P_{fan}(\Delta T_{air}) \tag{12 a}$$

$$= K_{comp} \cdot \Delta T_{chw} + K_{pump} \cdot \left(\frac{1}{\Delta T_{chw}}\right)^3 + K_{fan} \cdot \left(\frac{1}{\Delta T_{air}}\right)^3$$

for a dry surface cooling coil

From Eqns. C-3 and C-3 a in Appendix C, since we are assuming steady-state load conditions, the air flow rate and chilled water flow rate are at steady-state (constant) values (the second assumption) and we can relate the $\Delta T^*_{air}$ for the wet coil and the $\Delta T_{air}$ for the dry coil as follows:

$$K_3 \cdot CFM \cdot \Delta T^*_{air} = c \cdot m_{chw} \cdot \Delta T_{chw} \tag{13}$$

$$\Rightarrow \Delta T^*_{air} = K_3^* \cdot \Delta T_{chw} \quad \text{for the wet coil}$$

or $$K_3 \cdot CFM \cdot \Delta T_{air} = c \cdot m_{chw} \cdot \Delta T_{chw} \tag{13a}$$

$$\Rightarrow \Delta T_{air} = K_3 \cdot \Delta T_{chw} \quad \text{for the dry coil}$$

Therefore, both $\Delta T^*_{air}$ and $\Delta T_{air}$ are proportional to $\Delta T_{chw}$ and either of Eqns. 12 and 12a can be written:

$$P_{Tot}(\Delta T_{chw}) = K_{comp} \cdot \Delta T_{chw} + K_{pump} \cdot \left(\frac{1}{\Delta T_{chw}}\right)^3 + K_{fan}' \cdot \left(\frac{1}{\Delta T_{chw}}\right)^3 \tag{14}$$

for either a wet or dry surface cooling coil

By definition from differential calculus, a maximum or minimum of the total power curve, $P_{Tot}$, occurs at a $\Delta T_{chw} = \Delta T_{chw\ opt}$ when its first derivative is equal to zero:

$$\frac{d(P_{Tot})}{d(\Delta T_{chw})} = K_{comp} - 3K_{pump}(\Delta T_{chw\,opt})^{-4} - 3K'_{fan}(\Delta T_{chw\,opt})^{-4} = 0 \tag{15}$$

or equivalently:

$$K_{comp}(\Delta T_{chw\,opt})^4 - 3K_{pump} - 3K'_{fan} = 0$$

-continued $$\therefore \Delta T_{chw\,opt} = \sqrt[4]{\frac{3(K_{pump} + K'_{fan})}{K_{comp}}}$$

To determine the optimum delta T of the air across the cooling coil, either Eqn. 13 or 13a must be used. If it is assumed to be a wet cooling coil, then:

$$\frac{\Delta T^*_{air\,opt}}{\Delta T_{chw}} = \frac{c \cdot m_{chw}}{[1.08 + 4.5(0.45\omega)] \times CFM} \tag{15a}$$

$$\therefore \Delta T^*_{air\,opt} = \Delta T_{chw} \cdot \left\{\frac{c \cdot m_{chw}}{[1.08 + 4.5(0.45\omega)] \times CFM}\right\}$$

$$= \Delta T_{chw} \cdot \left\{\frac{500 \cdot GPM}{[1.08 + 4.5(0.45\omega)] \times CFM}\right\}$$

where c is the specific heat of water, ω is the specific humidity of the incoming air stream, and the mass flow rate $m_{chw}$ of chilled water has been replaced by the equivalent volumetric flow rate in GPM, multiplied by a conversion factor (500). Assuming that the chilled water valves in the cooling plant have been selected as equal percentage (which is the common design practice), we can calculate the GPM in Eqn. 15a directly from the control valve signal if we know the valve's authority (the ratio of the pressure drop across the valve when it is controlling to the pressure drop across the valve at full open position). The valve's authority can be determined from the valve manufacturer. The 1996 *ASHRAE* Systems and Equipment Handbook provides a functional relationship between percent flow rate of water through the valve versus the percent valve lift, so that the water flow through the valve can be calculated as:

$$GPM = (\text{Max flow}) \times f(\%\ \text{value lift}) \tag{15b}$$

$$= (\text{Max flow}) \times f(\%\ \text{full span of control signal})$$

where f is a nonlinear function defining the valve flow characteristic. Since the CFM and the humidity of the air stream can be either measured directly or calculated by the DDC system, we can calculate $\Delta T^*_{air\ opt}$ once $\Delta T_{chw\ opt}$ is known by the following procedure:

1. Calculate the GPM from Eqn. (15b).
2. Measure or calculate the CFM of the air across the cooling coil. CFM can be calculated from measured static pressure across the fan and manufacturer's fan curves.
3. Calculate the actual $\Delta T_{chw}$ across each cooling coil from the optimum chilled water supply temperature and known chilled water return temperature:

$$[1.08 + 4.5(0.45\omega)] \cdot CFM = 500 \cdot GPM \cdot (T_{chwr} - T_{chws\,opt}) \tag{15c}$$

$$\Rightarrow \Delta T_{chw} = \frac{[1.08 + 4.5(0.45\omega)] \cdot CFM}{500 \cdot GPM},$$

where $(T_{chwr} - T_{chws\,opt}) = \Delta T_{chw}$

4. Calculate $\Delta T^*_{air\ opt}$ once the actual $\Delta T_{chw}$ is known:

$$\Delta T^*_{air\,opt} = \Delta T_{chw} \cdot \left\{\frac{500 \cdot GPM}{[1.08 + 4.5(0.45\omega)] \times CFM}\right\} \tag{15d}$$

5. Finally, calculate the actual discharge air set point based on the known (measured) cooling coil inlet temperature:

$$T^*_{opt\ cc\ disch} = T^*_{cc\ inlet} - \Delta T^*_{air\ opt} \tag{15e}$$

To determine whether the $\Delta T_{chw\ opt}$ calculated in Eqn. 15 corresponds to a maximum or minimum total power, we take the second derivative of $P_{Tot}$ with respect to $\Delta T_{chw}$:

$$\frac{d^2(P_{Tot})}{d(\Delta T_{chw})^2} = (-3)\cdot(-4)\cdot K_{pump}(\Delta T_{chw\,opt})^{-5} + (-3)\cdot(-4)\cdot K'_{fan}(\Delta T_{chw\,opt})^{-5} \tag{16}$$

Since Eqn. 16 must always be positive, the function $P_{Tot}(\Delta T)$ must be concave upward and we see the calculated $\Delta T_{chw\ opt}$ in Eqn. 15 occurs at the minimum of $P_{Tot}$.

Note that for a wet surface cooling coil, the $\Delta T_{air}$ across the coil is really the wet bulb $\Delta T_{air} = \Delta T^*_{air}$. Thus, in the case for a wet surface cooling coil, a dew point sensor as well as a dry bulb temperature sensor would be required to calculate the inlet wet bulb temperature. The cooling coil discharge requires only a dry bulb temperature sensor, however, since we are assuming saturated conditions.

For a given measured $\Delta T_{chw}$ and a given load at steady-state conditions, $K_{comp}$, $K_{pump}$ and $K_{fan}$ can easily be calculated in a DDC controller from a single measurement of the compressor power, chilled water pump power and the air handler fan power, respectively, since we know the functional forms of $P_{comp}(\Delta T_{chw})$, $P_{pump}(\Delta T_{chw})$, and $P_{fan}(\Delta T_{chw})$, respectively. Once the optimum chilled water delta T has been found, the optimum air side delta T across the cooling coil can be calculated from a calculated value of the GPM of the chilled water, the known valve authority, and measured (or calculated) value of the fan CFM.

To implement the strategy in a DDC controller, the following steps are carried out for calculating the optimum chilled water and cooling coil air-side ΔT: 1. For each steady-state load condition:

a) determine $K_{pump}$ from a single measurement of the pump power and the $\Delta T_{chw}$:

$$K_{pump} = P_{pump} \times (\Delta T_{chw})^3 \tag{17}$$

b) determine $K_{fan}$ from a single measurement of the fan power and the $\Delta T_{chw}$:

$$K_{fan} = P_{fan} \times (\Delta T_{chw})^3 \tag{18}$$

c) determine $K_{comp}$ from a single measurement of the chiller power and the $\Delta T_{chw}$ at steady-state load conditions:

$$K_{comp} = \frac{P_{comp}}{\Delta T_{chw}} \tag{19}$$

2. Calculate the optimum ΔT for the chilled water in the PPCL program from the following formula:

$$\Delta T_{chw\,opt} = \sqrt[4]{\frac{3(K_{pump} + K_{fan})}{K_{comp}}} \tag{20}$$

3. Calculate the optimum chilled water supply set point from the following formulas: For a primary-only chilled water system:

$$\Delta T_{chw\,opt} = T_{chwr} - T_{chws} \tag{21}$$

$$\Rightarrow T_{chws\,opt} = T_{chwr} - \Delta T_{chw\,opt}$$

and $$\Delta T_{air\,opt} = T_{cc\,inlet} - T_{cc\,discharge}$$

$$\Rightarrow T_{cc\,discharge} = T_{cc\,inlet} - \Delta T_{air\,opt}$$

For a primary-secondary chilled water system the optimum secondary chilled water temperature from the optimum primary and optimum secondary chilled water differential temperatures can be calculated by making use of the fact that the calculated load in the primary loop must equal the calculated load in the secondary chilled water loop:

$$\Delta T_{sec\,chw\,opt} \times sflow = \Delta T_{chw,opt} \times pflow \tag{21a}$$

$$\Rightarrow \Delta T_{sec\,chw\,opt} = \Delta T_{chw\,opt} \times \left(\frac{pflow}{sflow}\right) = (T_{sec\,chwr} - T_{sec\,chws\,opt})$$

$$\therefore T_{sec\,chws\,opt} = T_{sec\,chwr} - \Delta T_{chw\,opt} \times \left(\frac{pflow}{sflow}\right)$$

where:

pflow=Primary chilled wafer loop flow sflow=Secondary chilled water loop flow

4. Calculate the optimum ΔT of the air across the cooling coil in the DDC control program from the following formula:

$$\Delta T^*_{air\,opt} = \Delta T_{chw} \cdot \left\{\frac{500 \cdot GPM}{[1.08 + 4.5(0.45\omega)] \times CFM}\right\}$$

5. Calculate the optimum cooling coil discharge air temperature (dry bulb or wet bulb) from the known (measured) cooling coil inlet temperature (dry bulb or wet bulb).

$$T^*_{opt\ cc\ disch} = T^*_{cc\ inlet} - \Delta T^*_{air\ opt}$$

or $$T_{opt\ cc\ disch} = T_{cc\ inlet} - \Delta T_{air\ opt}$$

6. After the load has assumed a new steady-state value, repeat steps 1–5.

In accordance with another important aspect of the present invention, the optimal chilled water/supply air delta T calculation can be made using a bi-quadratic chiller model. If the chiller is modeled by the more accurate bi-quadratic model of Eqn. 8, the expression for the total power becomes:

$$P_{Tot}(\Delta T_{chw}) = P_{comp}(\Delta T_{chw}) + P_{pump}(\Delta T_{chw}) + P_{fan}(\Delta T_{chw}) = P_{des}[(A_0 + A_1 y + A_2 y^2) + (B_0 + B_1 y + B_2 y^2)x + (C_0 + C_1 y + C_2 y^2)x^2] + K_{pump} \cdot \left(\frac{1}{\Delta T_{chw}}\right)^3 K'_{fan} \cdot \left(\frac{1}{\Delta T_{chw}}\right)^3 \tag{22}$$

for a wet surface cooling coil

As in the analysis for the linear chiller model, the expressions for a dry surface cooling coil are completely analogous as those for a wet coil. Therefore, only the expressions for a wet surface cooling coil will be presented here.

When the first derivative of Eqn. 22 is taken and equated to zero, then:

$$\frac{d(P_{Tot})}{d(\Delta T_{chw})} = P_{des}[(B_0 + B_1 y + B_2 y^2) + 2(C_0 + C_1 y + C_2 y^2)\Delta T_{chw\,opt}] \cdot \left[\frac{(\text{sec } CHW \text{ flow})}{24 \cdot (\text{chiller design tons})}\right] - 3K_{pump}(\Delta T_{chw\,opt})^{-4} - 3K_{fan}(\Delta T_{chw\,opt})^{-4} = 0 \tag{23}$$

or equivalently:

$$P_{des}\left[\frac{(\text{sec } CHW \text{ flow})}{24 \cdot (\text{chiller design tons})}\right] \cdot [2(C_0 + C_1 y + C_2 y^2)\Delta T_{chw\,opt}{}^5 + (B_0 + B_1 y + B_2 y^2)\Delta T_{chw\,opt}{}^4] - 3K_{pump} - 3K_{fan} = 0$$

Eqn. 23 is a fifth order polynomial, for which the roots must be found by means of a numerical method. Descartes' polynomial rule states that the number of positive roots is equal to the number of sign changes of the coefficients or is less than this number by an even integer. It can be shown that the coefficients $B_2$ and $C_2$ in Eqn. 23 are both negative, all other coefficients are positive, and since $K_{pump}$ and $K_{fan}$ must also be positive, Eqn. 23 has three sign changes. Therefore, there will be either three positive real roots or one positive real root of the equation. The first real root can be found by means of the Newton-Raphson Method and it can be shown that this is the only real root. The Newton-Raphson Method requires a first approximation to the solution of Eqn. 23. This approximation can be calculated from Eqn. 20, the results of using a linear chiller model. The Newton-Raphson Method and Eqn. 20 can easily be programmed into a DDC controller, so a root can be found to Eqn. 23.

Figure 3:
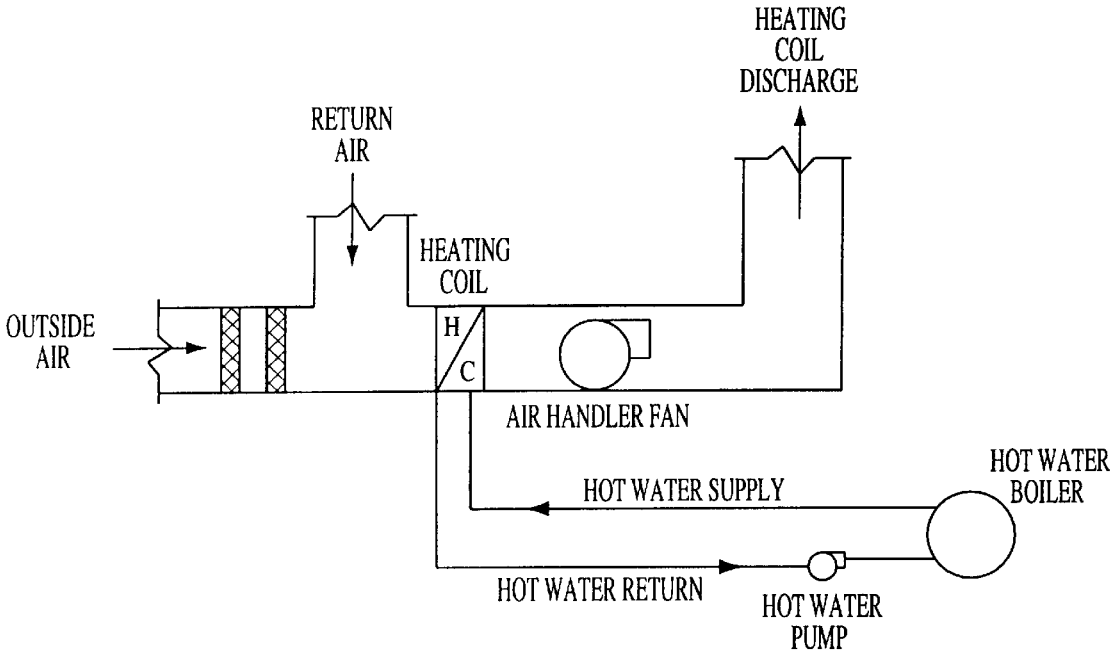
FIG. 3 is a schematic diagram of a generic heating plant consisting of equipment that includes a hot water boiler, a hot water pump and an air handling fan.

While the foregoing has related to a cooling plant, the present invention is also applicable to a heating plant such as is shown in FIG. 3, which shows the equipment being modeled in the heating plant. The model for the hot water pump and the air handler fan blowing across a heating coil is completely analogous to that for the cooling plant. The model for a hot water boiler can easily be derived from the basic definition of its efficiency:

$$\eta_{boiler} = \frac{m_{hw} \cdot c \cdot \Delta T_{hw}}{P_{boiler}} \tag{24}$$

where $c$ = specific heat of the hot water $$\therefore P_{boiler} = \frac{m_{hw} \cdot c \cdot \Delta T_{hw}}{\eta_{boiler}}$$

The hot water pump and air handler model derivations are completely analogous to the results derived for the chilled water pump and air handler fan, Eqns. 9 and 10, respectively:

$$P_{hw\,pump} = K_5 \cdot \left(\frac{1}{\Delta T_{hw}}\right)^3 \tag{25}$$

$$P_{fan} = K_{fan} \cdot \left(\frac{1}{\Delta T_{air}}\right)^3 \tag{26}$$

where $\Delta T_{air}$ is temperature difference across the hot water

The optimum hot water ΔT is completely analogous to the results derived for the linear chiller model, Eqn. 15:

$$\Delta T_{hw\,opt} = \sqrt[4]{\frac{3(K_{hw\,pump} + K_{fan})}{K_{boiler}}} \tag{27}$$

Therefore the optimum $\Delta T_{air}$ across the heating coil can be calculated once $\Delta T_{hw}$ is determined from:

$$\Delta T_{air\,opt} = \Delta T_{hw} \cdot \left\{\frac{500 \cdot GPM}{1.08 \times CFM}\right\} \tag{27-a}$$

The following are observations that can be made about the modeling techniques for the power components in a cooling and heating plant, as implemented in a DDC controller:

1. The "K" constants used in the modeling equations can be described as "characterization factors" that must be determined from measured power and $\Delta T_{chw}$ of each chiller, boiler, chilled and hot water pump and air handler fan at each steady-state load level. Determining these constants characterizes the power consumption curves of the equipment for each load level. The "K" characterization factors for the linear chiller model, the hot water boiler, the chilled and hot water pump, and air handler fan can easily be determined from only a single measurement of power consumed by that component and the ΔT of the chilled or hot water across that component at a given load level.

2. For each power consuming component of the cooling or heating plant, the efficiency of that component varies with the load. This is why it is necessary to recalculate the "K" characterization factors of the pumps and AHU fans and the A, B, and C coefficients of the chillers for each load level.

3. The use of constant speed or variable speed chillers, chilled water pumps, or air handler fans does not affect the general formula for $\Delta T_{chw\ opt}$ in Eqn. 15 or the solution of Eqn. 23. For example, if constant speed chilled water pumps with three-way chilled valves are used, the power component of the chilled water pump remains constant at any load level, and $\Delta T_{chw\ opt}$ in Eqn. 15 simplifies to:

$$\Delta T_{chw\,opt} = \sqrt[4]{\frac{3(K_{pump} + K_{fan})}{K_{comp}}} = \sqrt[4]{\frac{3K_{fan}}{K_{comp}}} \tag{28}$$

4. To determine the characterization factors for multiple chillers, chilled water pumps, and air handler fans, Appendices A, B, and C show that it is sufficient to determine the characterization factors for each piece of equipment from measured values of the power and $\Delta T_{chw}$ across each piece of equipment, and then sum the characterization factors for each piece of equipment to obtain the total power. For example, for a facility that has n chillers, m chilled water pumps, and o air handler fans currently on-line, the DDC controller must calculate:

$$\begin{aligned} P_{Tot} &= \sum_{n=1}^{n} P_{comp} + \sum_{m=1}^{m} P_{pump} + \sum_{o=1}^{o} P_{fan} \\ &= \Delta T_{chw} \cdot \sum (K_{comp,1} + K_{comp,2} + \ldots + K_{comp,n}) + \\ &\quad \left(\frac{1}{\Delta T_{chw}}\right)^3 \cdot \sum (K_{pump,1} + K_{pump,2} + \ldots + K_{pump,m}) + \\ &\quad \left(\frac{1}{\Delta T_{chw}}\right)^3 \cdot \sum (K_{fan,1} + K_{fan,2} + \ldots + K_{fan,o}) \end{aligned} \tag{29}$$

where $\Delta T_{chw} = K \cdot \Delta T_{air}$ for optimal operation

5. To determine when steady-state load conditions exist, cooling and heating load can be measured either in the mechanical room of the cooling or heating plant (from water-side flow and $\Delta T_{chw}$ or $\Delta T_{hw}$) or out in the space (from CFM of the fan or position of the chilled water or hot water valve). However, it is recommended that load be measured in the space because this will tend to minimize the transient effect due to the "flush time" of the chilled water through the system. Chilled water flush time is typically on the order of 15–20 minutes (Hackner et al. 1985). That is, by measuring load in the space, an optimal ΔT can be calculated that is more appropriate for the actual load rather than the load that existed 15 or 20 minutes previously, as would be calculated at the central plant mechanical room.

From the foregoing, it should be understood that an improved DDC controller for heating and/or cooling plants has been shown and described which has many advantages and desirable attributes. The controller is able to implement a control strategy that provides near-optimal global set points for a heating and/or cooling plant The controller is capable of providing set points that can provide substantial energy savings in the operation of a heating and cooling plant.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention which should be determined from the appended claims.

Various features of the invention are set forth in the appended claims.

APPENDIX A

Derivation of the Chiller Component of the Total Power (Linear Model)

Generic Derivation

For a generic chiller plant such as that shown in FIG. 1, Kaya et al. (1983) has shown that a first approximation for the chiller component of the total power can be derived by the following analysis. By definition, the efficiency of a refrigeration system can be written as:

$$\eta = \frac{Q_c}{P_{comp}} = \eta_e \cdot \eta_c \tag{A-1}$$

where $Q_c$ is the heat rejection in the condenser, $\eta_e$ lie is the equipment efficiency, and $\eta_c$ is the Carnot cycle efficiency. However, the Carnot cycle efficiency can be expressed as:

$$\eta_c = \frac{T_e}{T_c - T_e} = \frac{T_e}{\Delta T_{ref}} \tag{A-2}$$

where $T_e$=the temperature of the refrigerant in the evaporator $T_c$=the temperature of the refrigerant in the condenser Combining Eqns. A-1 and A-2, $$P_{comp} = \frac{Q_c}{\eta} = \frac{Q_c \cdot \Delta T_{ref}}{\eta_e \cdot T_e} = K_1 \cdot \Delta T_{ref} \tag{A-3}$$

Since $\Delta T_{ref}$ is directly proportional to $\Delta T_{chw}$, we can re-write Eqn. A-3 as:

$$P_{comp}=K_2 \cdot \Delta T_{chw} \tag{A-4}$$

Derivation For A Typical HVAC System

A typical HVAC system as shown in FIG. 2 consists of multiple chillers, chilled water pumps, and air handler fans. If we easily derive the power consumption of the three chillers in FIG. 2 from the basic results of the generic plant derivation. For each of the three chillers in FIG. 2, we can write:

$$\begin{aligned} P_{comp,T} &= P_{comp,1} + P_{comp,2} + P_{comp,3} \\ &= \sum_{n=1}^{3} P_{comp,n} = K_{comp,1} \cdot \Delta T_{chw,1} + K_{comp,2} \cdot \\ &\quad \Delta T_{chw,2} + K_{comp,3} \cdot \Delta T_{chw,3} \end{aligned} \tag{A-5}$$

Knowing that the chilled water ΔT's across each chiller must be identical for optimal operation (minimum power consumption), we can simplify Eqn. A-5 as:

$$P_{comp,T} = \sum_{n=1}^{3} P_{comp,n} = \Delta T_{chw}(K_{comp,1} + K_{comp,2} + K_{comp,3}) \tag{A-6}$$

APPENDIX B

Derivation of the Chilled Water Pump Component of the Total Power

Generic Derivation

For a generic chiller plant such as that shown in FIG. 1, Kaya et al. (1983) has derived the chilled water pump power component as follows. Pump power consumption can be expressed as:

$$P_{pump}=gmh \tag{B-1}$$

where g=the gravitational constant m=the mass flow rate of the pump h=the pressure head of the pump Since the mass flow rate of water is equal to the volumetric flow rate times the density, we have:

$$m=Q\rho \tag{B-2}$$

where

Q=the volumetric flow rate of the pump

ρ=the density of water

However, the volumetric flow rate of the pump can also be written as:

$$Q = K_1 \rho \sqrt{h} \tag{B-3}$$

Since the density of water, for all practical purposes, is constant for the temperature range experience in chilled water systems (5°–15° F.), we can write:

$$m = K_2 \sqrt{h} \tag{B-4}$$

Combining Eqns. B-1 and B-4, we have:

$$P_{pump}=K_3 g m^3 \tag{B-5}$$

For the heat transfer in the evaporator, we can write:

$$Q_e=c_{chw} \cdot m \cdot \Delta T_{chw} \tag{B-6}$$

where $c_{chw}$ is the specific heat of water (constant). Solving Eqn. B-6 for m, we have:

$$m = \frac{Q_e}{c_{chw} \cdot \Delta T_{chw}} \tag{B-7}$$

Because m in Eqn. B-7 is the same mass flow as in Eqn. B-5, we can substitute Eqn. B-7 into B-5. When this is done, we have:

$$P_{pump} = K_3 \cdot g \cdot \left(\frac{Q_e}{c_{chw} \cdot \Delta T_{chw}}\right)^3 = K_4 \cdot \left(\frac{Q_e}{c_{chw} \cdot \Delta T_{chw}}\right)^3 \tag{B-8}$$

where $K_4$ is a constant which includes $K_3$ and g. Note that under a steady-state assumption, $Q_e$ must be a constant. Therefore, $$P_{pump} = K_5 \cdot \left(\frac{1}{\Delta T_{chw}}\right)^3 \tag{B-9}$$

where $K_5$ is a constant which includes $K_4$, $Q_e$, and $C_{chw}$.

Derivation For A Typical HVAC System

For the typical HVAC system as shown in FIG. 2, we can derive the power consumption for the chilled water pumps as follows:

$$P_{pump,T}=P_{pump,1}+P_{pump,2}+P_{pump,3}+P_{pump,4}=g(m_1h_1+m_2h_2+m_3h_3+m_4h_4) \tag{B-10}$$

Using the relationships developed above for the generic case, we can write the following equations for this system:

$$m_1 = Q_1 d \quad Q_1 = K_1 d\sqrt{h_1} \Rightarrow m_1 = K_1 d^2\sqrt{h_1} = K_1'\sqrt{h_1} = \frac{Q_{e1}}{c_{chw} \cdot \Delta T_{chw,1}} \tag{B-11}$$

$$m_2 = Q_2 d \quad Q_2 = K_2 d\sqrt{h_2} \Rightarrow m_2 = K_2 d^2\sqrt{h_2} = K_2'\sqrt{h_2} = \frac{Q_{e2}}{c_{chw} \cdot \Delta T_{chw,2}}$$

$$m_3 = Q_3 d \quad Q_3 = K_3 d\sqrt{h_3} \Rightarrow m_3 = K_3 d^2\sqrt{h_3} = K_3'\sqrt{h_3} = \frac{Q_{e3}}{c_{chw} \cdot \Delta T_{chw,3}}$$

$$m_4 = Q_4 d \quad Q_4 = K_4 d\sqrt{h_4} \Rightarrow m_4 = K_4 d^2\sqrt{h_4} = K_4'\sqrt{h_4}$$

Substituting the results of Eqn. B-11 into Eqn. B-10, we obtain:

$$P_{pump,1}+P_{pump,2}+P_{pump,3}+P_{pump,4}=K_1''m_1^3+K_2''m_2^3+K_3''m_3^3+K_4''m_4^3 \tag{B-12}$$

The mass flow rate of the secondary chilled water, $m_4$, is related to the total BTU output of the chillers, and the primary chilled water ΔT is related to the secondary chilled water ΔT, so we can solve for $m_4$ as follows:

$$Q_T = Q_{e1} + Q_{e2} + Q_{e3} \tag{B-13}$$

$$\Delta T_{chw} \cdot pchwflow = \Delta T_{\sec chw} \cdot schwflow \Rightarrow \Delta T_{\sec chw} = \Delta T_{chw}\left(\frac{pchwflow}{schwflow}\right)$$

-continued $$\therefore m_4 = \frac{Q_T}{c_{chw} \cdot \Delta T_{chw} \cdot \left(\frac{pchwflow}{schwflow}\right)}$$

Now, since $$\left(\frac{pchwflow}{schwflow}\right) \text{ and } \frac{Q_T}{c_{chw}}$$

are constant under steady-state load conditions, we can finally write the expression of chilled water pump power for the entire system as follows:

$$\begin{aligned} P_{pump,T} &= P_{pump,1} + P_{pump,2} + P_{pump,3} + P_{pump,4} \\ &= K_{pump,1}\left(\frac{1}{\Delta T_{chw}}\right)^3 + K_{pump,2}\left(\frac{1}{\Delta T_{chw}}\right)^3 + K_{pump,3}\left(\frac{1}{\Delta T_{chw}}\right)^3 + K_{pump,4}\left(\frac{1}{\Delta T_{chw}}\right)^3 \\ &= \left(\frac{1}{\Delta T_{chw}}\right)^3 \cdot (K_{pump,1} + K_{pump,2} + K_{pump,3} + K_{pump,4}) \end{aligned} \tag{B-14}$$

APPENDIX C

Derivation of the Air Handler Component of the Total Power

Generic Derivation

For a generic chiller plant such as that shown in FIG. 1, if we were to extend the technique in Appendix B to air handler fans, we know the following relationships:

From the basic fan power equation, for any given fan load we have:

$$P_{fan} = \frac{CFM \cdot p}{6356 \cdot \eta_f \cdot \eta_m} = K_1 \cdot CFM \cdot p \tag{C-1}$$

where: $P_{fan}$=Power consumption of the air handler in KW p=total pressure rise across fan in"$H_2O$ $\eta_f$=fan efficiency $\eta_m$=fan motor efficiency 6356=conversion constant In Eqn. C-1, we have assumed $\eta_f$ and $\eta_m$ to be constant for a given steady-state load condition. From Bernoulli's Eqn, we can derive:

$$CFM = K_2 \cdot \sqrt{p} \tag{C-2}$$

By conservation of energy the air-side heat transfer must equal the water-side heat transfer at the cooling coil. Assuming that dehumidification occurs at the cooling coil, we must account for both sensible and latent load across the coil. Knowing that the wet bulb temperature and enthalpy of an air stream are proportional (e.g. on a psychrometric chart, wet bulb temperature lines are almost parallel with enthalpy lines), we can write the following relationship:

$$4.5 \cdot CFM \cdot \Delta h_{air} = (60 \times 0.075) \cdot CFM \cdot \Delta h_{air} = K_3 \cdot CFM \cdot \Delta T^*_{air} = c_{chw} \cdot m_{chw} \cdot \Delta T_{chw} \tag{C-3}$$

where:

$\Delta T_{air}^*$=Wet bulb temperature difference across cooling coil $C_{chw}$=Specific heat of water 60=60 min 1 hr 0.075=Density of standard air in lbs dry air 1 $ft^3$ Note that we have assumed that $\Delta h_{air}$ is primarily a function of the wet bulb temperature difference, $\Delta T_{air}^*$, across the coil. If we were to assume a dry surface cooling coil, Eqn. C-3 would simplify to:

$$(60\times0.075)\cdot(0.24+0.45\omega)\cdot CFM\cdot\Delta T_{air}=K_3\cdot CFM\cdot\Delta T_{air}=c\cdot m_{chw}\cdot\Delta T_{chw} \quad \text{(C-3a)}$$

where:

$\Delta T_{air}$=Dry bulb temperature difference across cooling coil $(0.24+0.45\omega)$=Specific heat of moist air In Eqns. C-3 and C-3a, we have also assumed that the specific heat of water and the specific heat of moist or dry air are constant for a given load level. This assumption is valid since the specific heat is only a weak function of temperature and the temperature change of either the water or air through the cooling coil is small (on the order 5–15° F.). Solving Eqn. C-3 for CFM and substituting the result into Eqn. C-2, we can solve for p:

$$CFM = \frac{c\cdot m_{chw}\cdot\Delta T_{chw}}{K_3\cdot\Delta T_{air}^*} = K_4\cdot m_{chw}\cdot\left(\frac{\Delta T_{chw}}{\Delta T_{air}^*}\right) = K_2\cdot\sqrt{p} \quad \text{(C-4)}$$

$$\Rightarrow p = K_5\cdot(m_{chw})^2\cdot\left(\frac{\Delta T_{chw}}{\Delta T_{air}^*}\right)^2$$

It can be shown that the work of the pump is related to the mass flow of water by the equation:

$$P_{pump} = K_6\cdot m_{chw}^3 \quad \text{(C-5)}$$

$$\therefore m_{chw} = K_7\cdot\sqrt[3]{P_{pump}}$$

Substituting Eqns. C-2, C-3, and C-5 back into Eqn. C-1 and simplifying, we have:

$$\begin{aligned} P_{fan} &= K_1\cdot\left(K_2\sqrt{p}\right)\cdot p = K_8\cdot(p)^{3/2} \quad \text{(C-6)}\\ &= K_8\cdot\left[K_5\cdot(m_{chw})^2\cdot\left(\frac{\Delta T_{chw}}{\Delta T_{air}^*}\right)^2\right]^{3/2}\\ &= K_9\cdot\left[(m_{chw})^3\cdot\left(\frac{\Delta T_{chw}}{\Delta T_{air}^*}\right)^3\right]\\ &= K_9\cdot\left[\left(K_7\cdot\sqrt[3]{P_{pump}}\right)^3\cdot\left(\frac{\Delta T_{chw}}{\Delta T_{air}^*}\right)^3\right]\\ &= K_{10}\cdot\left[P_{pump}\cdot\left(\frac{\Delta T_{chw}}{\Delta T_{air}^*}\right)^3\right]\\ &= K_{10}\cdot\left[K_{pump}\left(\frac{1}{\Delta T_{chw}}\right)^3\cdot\left(\frac{\Delta T_{chw}}{\Delta T_{air}^*}\right)^3\right]\end{aligned}$$

$$\therefore P_{fan} = \left[K_{fan}\left(\frac{1}{\Delta T_{air}^*}\right)^3\right]$$

Derivation For A Typical HVAC System

For the typical HVAC system as shown in FIG. 2, the power consumption for the air handler fans can be derived as follows:

$$\begin{aligned} P_{fan,T} &= P_{fan,1} + P_{fan,2} + P_{fan,3} \quad \text{(C-7)}\\ &= K_8[(p_1)^{3/2} + (p_2)^{3/2} + (p_3)^{3/2}]\end{aligned}$$

-continued $$\begin{aligned} &= K_8\left\{\left[K_5' m_{s1}^2\left(\frac{\Delta T_{s1}}{\Delta T_{air,1}^*}\right)^2\right]^{3/2} + \left[K_5'' m_{s2}^2\left(\frac{\Delta T_{s2}}{\Delta T_{air,2}^*}\right)^2\right]^{3/2} + \left[K_5''' m_{s3}^2\left(\frac{\Delta T_{s3}}{\Delta T_{air,3}^*}\right)^2\right]^{3/2}\right\}\\ &= \left[K_9 m_{s1}^3\left(\frac{\Delta T_{s1}}{\Delta T_{air,1}^*}\right)^3 + K_{10} m_{s2}^3\left(\frac{\Delta T_{s2}}{\Delta T_{air,2}^*}\right)^3 + K_{11} m_{s3}^3\left(\frac{\Delta T_{s3}}{\Delta T_{air,3}^*}\right)^3\right]\end{aligned}$$

If we break down the total secondary chilled water pumping power into three smaller segments, corresponding to the flow needs of each sub-circuit, we can write:

$$\begin{aligned} P_{pump,4} &= K_{e6}' m_{s1}^3 + K_{e6}'' m_{s2}^3 + K_{e6}''' m_{s3}^3 \quad \text{(C-8)}\\ &= K_{es1}\cdot\left(\frac{1}{\Delta T_{s1}}\right)^3 + K_{es2}\cdot\left(\frac{1}{\Delta T_{s2}}\right)^3 + K_{es3}\cdot\left(\frac{1}{\Delta T_{s3}}\right)^3\end{aligned}$$

and substitute this into Eqn. C-7, we obtain:

$$\begin{aligned} P_{fan,T} &= P_{fan,1} + P_{fan,2} + P_{fan,3} \quad \text{(C-9)}\\ &= \left[K_{fan,1}'\left(\frac{1}{\Delta T_{air,1}^*}\right)^3 + K_{fan,2}'\left(\frac{1}{\Delta T_{air,2}^*}\right)^3 + K_{fan,3}'\left(\frac{1}{\Delta T_{air,3}^*}\right)^3\right]\end{aligned}$$

Knowing that the $\Delta T_{air}^*$ across each air handler fan cooling coil must be proportional to $\Delta T_{chw}$, and knowing that the $\Delta T_{chw}$ across each coil must be identical, we can simplify Eqn. C-9as:

$$P_{fan,T} = \left(\frac{1}{\Delta T_{chw}}\right)^3\cdot(K_{fan,1} + K_{fan,2} + K_{fan,3}) \quad \text{(C-10)}$$

What is claimed is:

1. A controller for controlling at least a cooling plant of the type which has a primary-only chilled water system, and the plant comprises at least one of each of a cooling tower means, a chilled water pump, an air handling fan, an air cooling coil, a condenser, a condenser water pump, a chiller and an evaporator, said controller being adapted to provide near-optimal global set points for reducing the power consumption of the cooling plant to a level approaching a minimum, said controller comprising:

processing means adapted to receive input data relating to measured power consumption of the chiller, the chilled water pump and the air handler fan, and to generate output signals indicative of set points for controlling the operation of the cooling plant, said processing means including storage means for storing program information and data relating to the operation of the controller;

said program information being adapted to determine the optimum chilled water delta $T_{chw\ opt}$ across the evaporator for a given load and measured delta $T_{chw}$, utilizing the formula:

$$\Delta T_{chw\,opt} = \sqrt[4]{\frac{3(K_{pump} + K_{fan})}{K_{comp}}}$$

where:

$$K_{pump}=P_{pump}\times(\Delta T_{chw})^3$$

$$K_{fan}=P_{fan}\times(\Delta T_{chw})^3$$

and $$K_{comp} = \frac{P_{comp}}{\Delta T_{chw}}$$

said program information being adapted to determine the optimum chilled water supply set point utilizing the formula:

$$T_{chws\ opt}=T_{chw}-\text{delta}T_{chw\ opt}$$

and to output a control signal to said cooling plant to produce said $T_{chws\ opt}$;

said program information being adapted to determine the optimum air delta $T_{air\ opt}$ across the cooling coil utilizing the formula:

$$\Delta T^*_{air\,opt} = \Delta T_{chw} \cdot \left\{\frac{500 \cdot GPM}{[1.08 + 4.5(0.45\omega)] \times CFM}\right\}$$

said program information being adapted to determine the optimum cooling coil discharge air temperature from the measured cooling coil inlet temperature using the formula:

$$T_{opt\ cc\ disch}=T_{cc\ inlet}-\text{delta}\ T_{air\ opt}$$

and to output a control signal to said cooling plant to produce said $T_{opt\ cc\ disch}$.

2. A controller as defined in claim 1 wherein said program information is adapted to determine the near-optimum cooling tower air flow utilizing the formula:

$$G_{twr}1-\beta_{twr}(PLR_{twr,cap}-PLR)0.25<PLR<1.0$$

where $G_{twr}$=the tower air flow divided by the maximum air flow with all cells operating at high speed PLR=the chilled water load divided by the total chiller cooling capacity (part-load ratio)

$PLR_{twr,cap}$=value of PLR at which the tower operates at its capacity ($G_{twr}$=1)

$\beta_{twr}$=the slope of the relative tower air flow ($G_{twr}$) versus the PLR function.

3. A controller as defined in claim 2 wherein said program information is adapted to determine the near-optimum condenser water flow by determining the cooling tower effectiveness by using the equation $$\varepsilon = \frac{Q_{tower}}{\text{Min}(Q_{a,\max}, Q_{w,\max})}$$

where $\epsilon$=effectiveness of cooling tower $Q_{a,\ max}=m_{a,twr}(h_{s,cwr}-h_{s,i})$, sigma energy,$h_{s,__}=h_{air,__}-\omega__c_{pw}T_{wb}$ $Q_{w,\ max}=m_{cw}c_{pw}(T_{cwr}-T_{wb})$ $m_{a,\ twr}$=tower air flow rate $m_{cw}$=condenser water flow rate $T_{cwr}$=condenser water return temperature $T_{wb}$=ambient air wet bulb temperature and by then equating $Q_{a,\ max}$ and $Q_{w,\ max}$ to calculate $m_{cw}$ once $m_{a,twr}$ has been determined.

4. A controller as defined in claim 3 wherein said optimum cooling coil discharge air temperature is a dry bulb temperature when said $T_{cc\ inlet}$ and delta $T_{air\ opt}$ values are dry bulb temperatures, and said optimum cooling coil discharge air temperature is a wet bulb temperature when said $T_{cc\ inlet}$ and delta $T_{air\ opt}$ values are wet bulb temperatures.

5. A controller for controlling at least a cooling plant of the type which has a primary-secondary chilled water system, and the cooling plant comprises at least one of each of a cooling tower means, a chilled water pump, an air handling fall, an air cooling coil, a condenser, a condenser water pump, a chiller and an evaporator, said controller being adapted to provide near-optimal global set points for reducing the power consumption of the cooling plant to a level approaching a minimum, said controller comprising:

processing means adapted to receive input data relating to measured power consumption of the chiller, the chilled water pump and the air handler fan, and to generate output signals indicative of set points for controlling the operation of the cooling plant, said processing means including storage means for storing program information and data relating to the operation of the controller;

said program information being adapted to determine the optimum chilled water delta $T_{chw\ opt}$ across the evaporator for a given load and measured delta $T_{chw}$, utilizing the formula:

$$\Delta T_{chw\,opt} = \sqrt[4]{\frac{3(K_{pump} + K_{fan})}{K_{comp}}}$$

where:

$$K_{pump}=P_{pump}\times(\Delta T_{chw})^3$$

$$K_{fan}=P_{fan}\times(\Delta T_{chw})^3$$

and $$K_{comp} = \frac{P_{comp}}{\Delta T_{chw}}$$

said program information being adapted to determine the optimum chilled water supply set point utilizing the formula:

$$T_{sec\ chws\ opt}=T_{sec\ chwr}-\text{delta}T_{chw\ opt}\times(\text{pflow/sflow})$$

where pflow=Primary chilled water loop flow, and sflow=Secondary chilled water loop flow and to output a control signal to said cooling plant to produce said $T_{chwr\ opt}$;

said program information being adapted to determine the optimum air delta $T_{air\ opt}$ across the cooling coil utilizing the formula:

$$\Delta T^{*}_{air\,opt} = \Delta T_{chw} \cdot \left\{ \frac{500 \cdot GPM}{[1.08 + 4.5(0.45\omega)] \times CFM} \right\}$$

said program information being adapted to determine the optimum cooling coil discharge air temperature from the measured cooling coil inlet temperature using the formula:

$$T_{opt\ cc\ disch} = T_{cc\ inlet} - \text{delta}T_{air\ opt}$$

and to output a control signal to said cooling plant to produce said $T_{opt\ cc\ disch}$.

6. A controller for controlling at least a heating plant of the type which has at least one of each of a hot water boiler, a hot water pump and an air handler fan, said controller being adapted to provide near-optimal global set points for reducing the power consumption of the heating plant to a level approaching a minimum, said controller comprising:

processing means adapted to receive input data relating to measured power consumption of the chiller, the chilled water pump and the air handler fan, and to generate output signals indicative of set points for controlling the operation of the cooling plant, said processing means including storage means for storing program information and data relating to the operation of the controller;

said program information being adapted to determine the optimum hot water delta $T_{hw\ opt}$ across the input and output of the hot water boiler for a given load and measured delta $T_{hw,}$ utilizing the formula:

$$\Delta T_{hw\,opt} = \sqrt[4]{\frac{3(K_{hw\ pump} + K_{fan})}{K_{boiler}}}$$

and to determine the optimum $\Delta T_{air}$ across the heating coil can be calculated once $\Delta T_{hw}$ is determined from the equation:

$$\Delta T_{air\,opt} = \Delta T_{hw} \cdot \left\{ \frac{500 \cdot GPM}{1.08 \times CFM} \right\}.$$

7. A method of determining near-optimal global set points for reducing the power consumption to a level approaching a minimum for a cooling plant operating in a steady-state condition, said set points including the optimum temperature change across an evaporator in a cooling plant of the type which has at least one of each of a cooling tower means, a chilled water pump, an air handling fan, an air cooling coil, a condenser, a condenser water pump, a chiller and an evaporator, said set points being determined in a direct digital electronic controller adapted to control the cooling plant, the method comprising:

measuring the power being consumed by the chilled water pump, the air handling fan and the chiller and the actual temperature change across the evaporator;

calculating the K constants from the equations $$K_{pump} = P_{pump} \times (\Delta T_{chw})^3,\ K_{fan} = P_{fan} \times (\Delta T_{chw})^3 \text{ and } K_{comp} = \frac{P_{comp}}{\Delta T_{chw}};$$

calculating the optimum ΔT for the chilled water from the following formula:

$$\Delta T_{chw\,opt} = \sqrt[4]{\frac{3(K_{pump} + K_{fan})}{K_{comp}}}$$

8. A method as defined in claim 7 further including determining a set point for the optimal temperature change across the cooling coil from the formula $$\Delta T^{*}_{air\,opt} = \Delta T_{chw} \cdot \left\{ \frac{500 \cdot GPM}{[1.08 + 4.5(0.45\omega)] \times CFM} \right\}.$$

* * * * *

UNITED STATES PATENT AND TRADEMARK OFFICE

CERTIFICATE OF CORRECTION

PATENT NO. : 5,963,458

DATED : October 5, 1999

INVENTOR(S) : Mark A. Cascia

It is certified that error appears in the above-indentified patent and that said Letters Patent is hereby corrected as shown below:

In the Abstract, line 5, delete "Tile" and insert --The--.

Column 2, line 34, after "=" insert --1--.

Column 9, line 1, after the equation insert --for a dry cooling coil, and--.

Column 9, line 2, after the equation insert --for a wet cooling coil where $\Delta T_{air}^{*}$ is the wet bulb--.

Column 13, line 64, after "water" insert --coil.--.

Column 15, line 46, delete "lie".

Column 17, line 23, delete "$C_{chw}$" and insert --$c_{chw}$--.

Column 19, line 2, delete "1" and insert --/--.

Column 19, line 3, delete "1" and insert --/--.

Column 19, line 10, after "$m_{chw}$" delete the garbled language and insert --$\Delta T_{chw}$--, and identify the equation as "(C-3a)".

Column 21, line 1, after "$K_{fan}$" insert --)--.

Column 22, line 19, delete "fall" and insert --fan--.

Column 22, line 36, after "$K_{fan}$" insert --)--.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*